US007165341B2

(12) United States Patent
Saida et al.

(10) Patent No.: US 7,165,341 B2
(45) Date of Patent: Jan. 23, 2007

(54) HAIR DRYER WITH MINUS ION GENERATOR

(75) Inventors: Itaru Saida, Hikone (JP); Kiyoshi Takashima, Hikone (JP); Kenji Kamada, Hikone (JP); Hiroyuki Takano, Kusatsu (JP); Kengo Ito, Hikone (JP); Akinobu Mizuta, Yokohama (JP); Takashi Nakagawa, Hikone (JP)

(73) Assignee: Matsushita Electric Works, Ltd., Osaka (JP)

( * ) Notice: Subject to any disclaimer, the term of this patent is extended or adjusted under 35 U.S.C. 154(b) by 0 days.

(21) Appl. No.: 11/239,197

(22) Filed: Sep. 30, 2005

(65) Prior Publication Data

US 2006/0026858 A1 Feb. 9, 2006

Related U.S. Application Data

(63) Continuation of application No. 10/742,807, filed on Dec. 23, 2003, now Pat. No. 6,986,212.

(30) Foreign Application Priority Data

Dec. 27, 2002 (JP) ..... 2002-381947
Jun. 13, 2003 (JP) ..... 2003-169880

(51) Int. Cl.
*A45D 20/12* (2006.01)

(52) U.S. Cl. ..... 34/98

(58) Field of Classification Search ..... 34/96, 34/97, 98, 283; 392/383, 384, 385
See application file for complete search history.

(56) References Cited

U.S. PATENT DOCUMENTS 3,612,824 A * 10/1971 Berryman et al. ..... 392/383
3,885,127 A 5/1975 Walter et al.
3,943,329 A 3/1976 Hlavac
5,091,630 A 2/1992 Djuric
6,393,718 B1 5/2002 Harris et al.
2004/0020070 A1 2/2004 Ito

FOREIGN PATENT DOCUMENTS

| | | |
|---|---|---|
| DE | 90 01 199 U1 | 6/1990 |
| EP | 0 970 633 A1 | 1/2000 |
| EP | 1 266 588 A2 | 12/2002 |
| JP | 08-047415 A1 | 2/1996 |
| JP | 2000-201723 A1 | 7/2000 |

OTHER PUBLICATIONS

EPO Communication, Partial European Search Report mailed on Apr. 15, 2004.

* cited by examiner

*Primary Examiner*—Kenneth Rinehart
(74) *Attorney, Agent, or Firm*—Rader, Fishman & Grauer PLLC; Carl Schaukowitch

(57) ABSTRACT

A hair dryer is provided, which includes a housing having an air outlet, fan disposed in the housing, a pair of air flow channels extending toward the air outlet in the housing, a partition wall for separating the channels from each other, heater disposed in only one of the channels, and a minus-ion generator disposed in the other channel. The partition wall is formed by a tubular member, which is disposed in the housing such that one of the channels is provided by an inner space of the tubular member, and the other channel is provided by a clearance between an inner surface of the housing and an outer surface of the tubular member. Therefore, it is possible to simultaneously provide a cold air flow with minus ions and a hot air flow from the air outlet, and thereby efficiently perform hair styling.

6 Claims, 9 Drawing Sheets

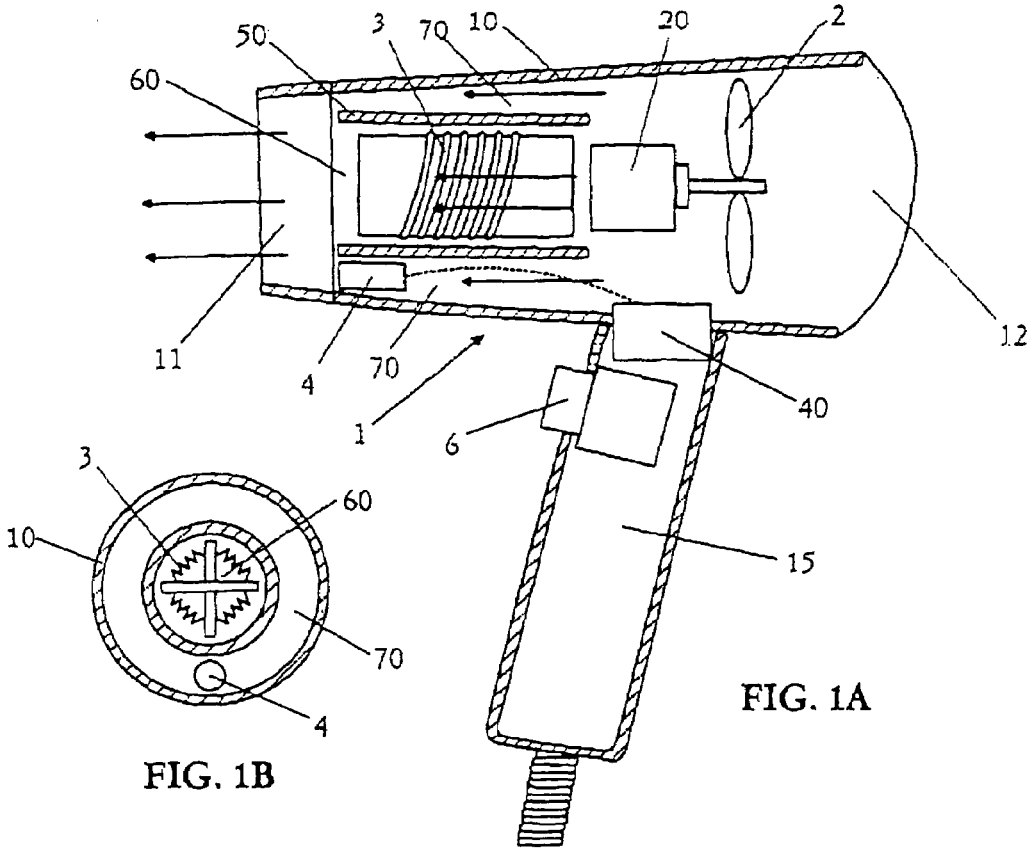
FIG. 1A
FIG. 1B
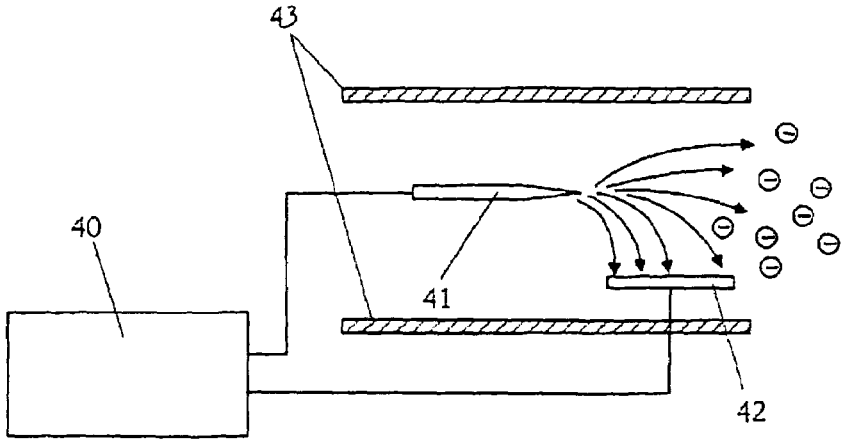
FIG. 2A
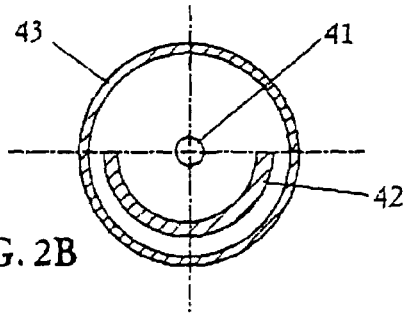
FIG. 2B

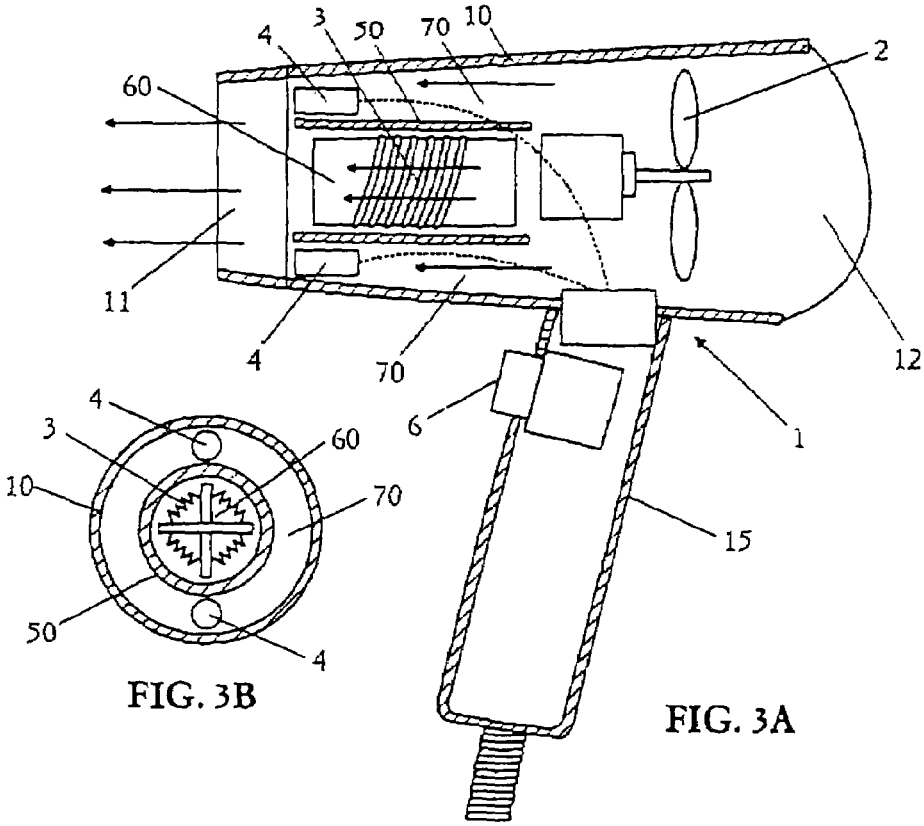
FIG. 3B
FIG. 3A
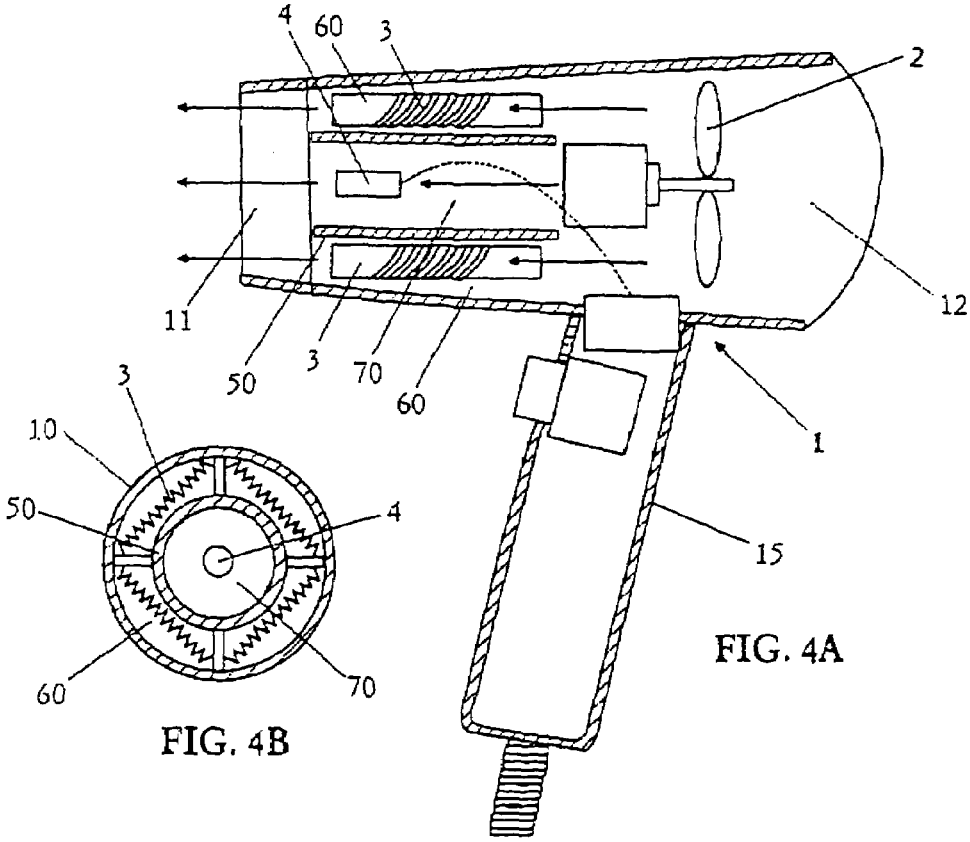
FIG. 4B
FIG. 4A

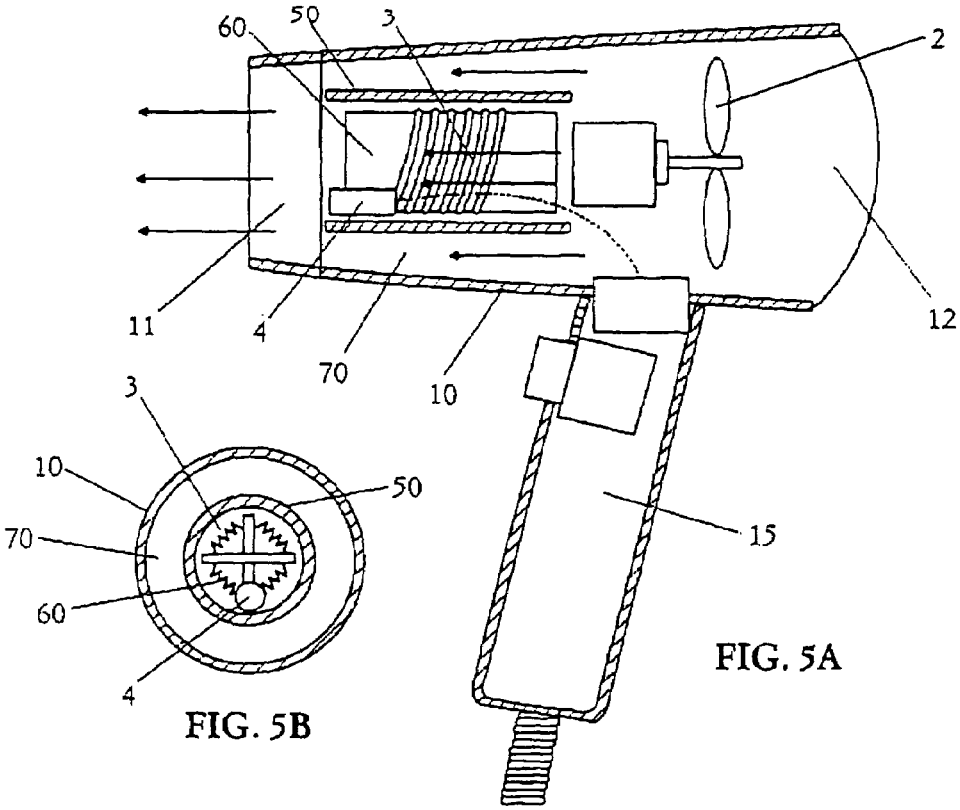
FIG. 5A
FIG. 5B
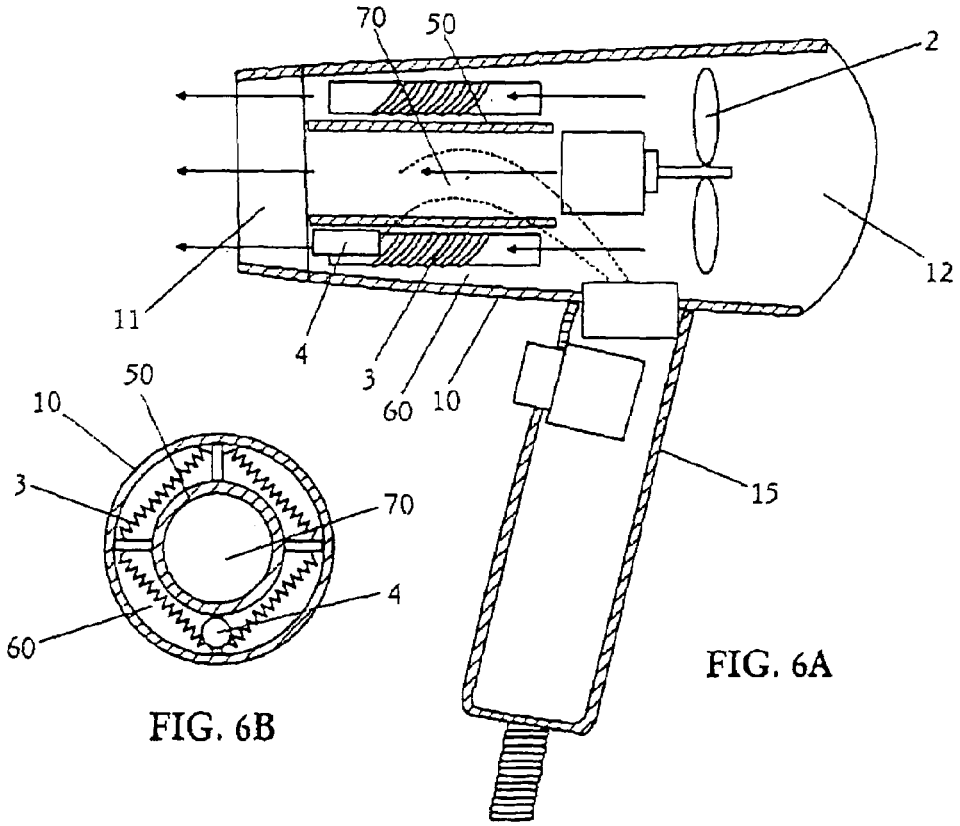
FIG. 6A
FIG. 6B

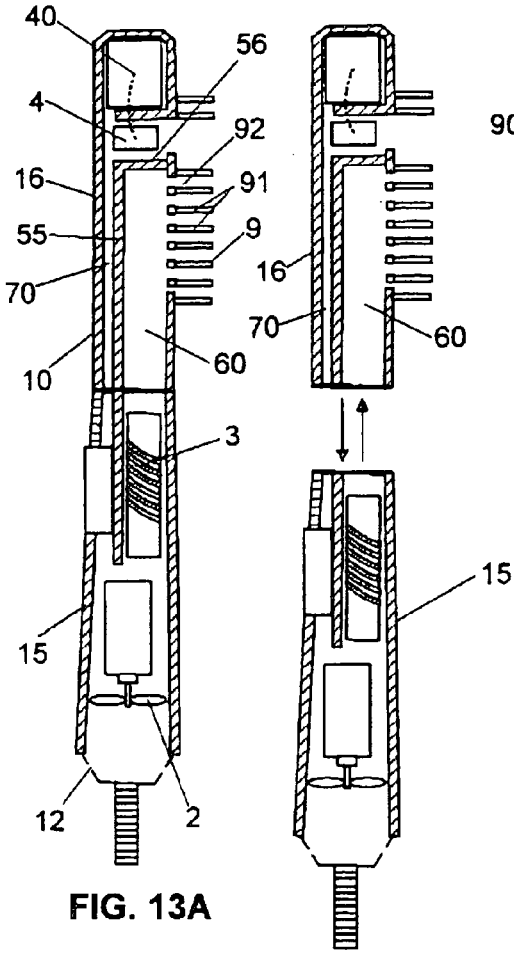
FIG. 13A
FIG. 13B
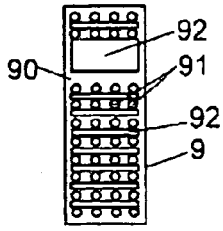
FIG. 13C
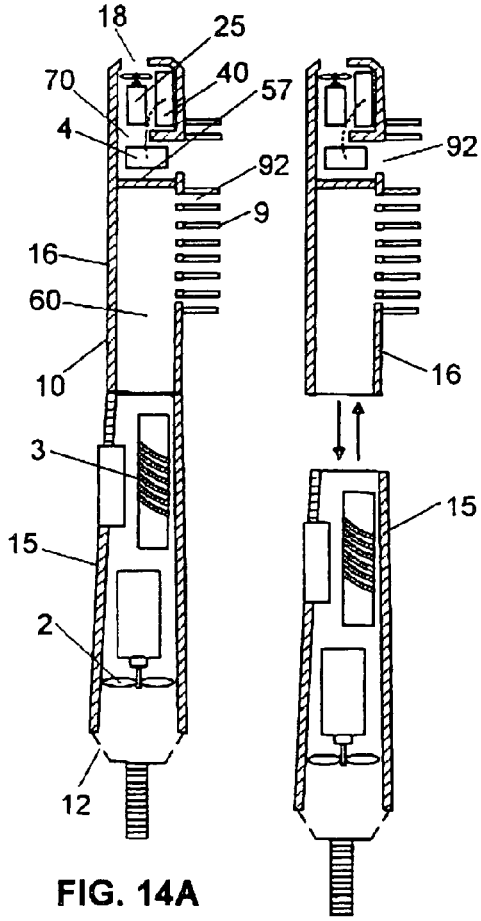
FIG. 14A
FIG. 14B

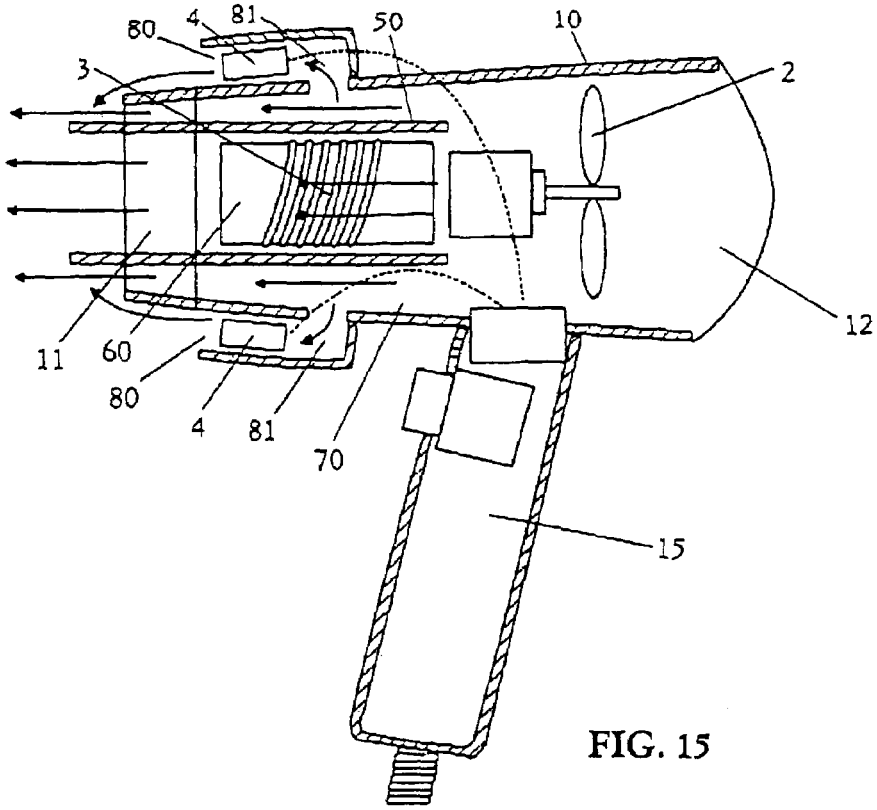
FIG. 15
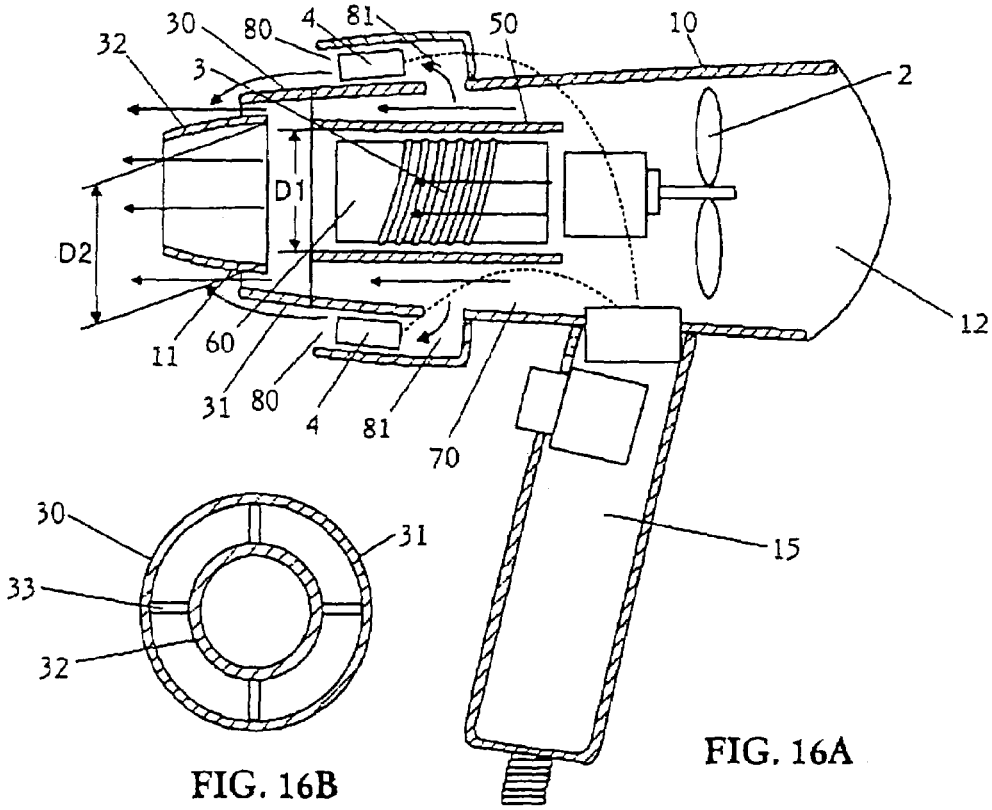
FIG. 16B
FIG. 16A

HAIR DRYER WITH MINUS ION GENERATOR

CROSS REFERENCE TO RELATED APPLICATIONS

The present application is a Continuation Application of the patent application Ser. No. 10/742,807, filed Dec. 23, 2003 now U.S. Pat. No. 6,986,212, which is based on Priority claim JP-2002-381947 filed on Dec. 27, 2002, the entire contents of which are incorporated herein by reference.

BACKGROUND OF THE INVENTION

1. Field of the Invention

The present invention relates to a hair dryer with a minus ion generator, which has the capability of simultaneously providing a cold air flow with minus ions and a hot air flow to efficiently perform hair styling as well as hair treatment.

2. Disclosure of the Prior Art

In the past, it is said that an air flow with minus ions is effective to perform hair styling, while keeping the moisture content of hair. Therefore, various kinds of hair dryers with minus ion generator have been proposed.

For example, Japanese Utility Model Registration No. 3086680 discloses a hair dryer 1M with a minus ion generator 4M, as shown in FIG. 17. This dryer includes a tubular housing 10M, in which an air flow channel 60M is defined, so that air sucked from an air inlet 12M provided at one end of the housing is ejected from an air outlet 11M provided at the other end thereof. In the air-flow channel 60M of the housing 10M, a fan 2M, heater 3M, and the minus ion generator 4M are disposed. In addition, the hair dryer has a grip 15M projecting downwardly from the housing 10M, in which electric circuits for the heater and the fan are accommodated.

When a power switch 6M provided on the grip 15M is turned on, electric power is supplied to the fan 2M, heater 3M, and the minus ion generator 4M. The air is sucked into the housing 10M from the air inlet 12M by the fan 2M, and then sent to the downstream side of the air flow channel 60M. Subsequently, the air is heated by the heater 3M in the air flow channel, and the heated air is mixed with minus ions generated by the minus ion generator 4M. Thus, the hot air flow with minus ions is ejected from the air outlet 11M.

In addition, PCT International Publication No. WO02/51282 A1 discloses a hair dryer 1N having the capability of individually providing a hot air flow and minus ions from different outlets, as shown in FIG. 18. This hair dryer 1N has a hollow housing 10N with an air inlet 12N and an air outlet 11N, and an air flow channel 60N formed therebetween, in which a fan 2N and a heater 3N are disposed. The air sucked in the housing by the fan 2N is heated by the heater 3N, and then ejected from the air outlet 11N. The housing 10N also has an ion-flow channel 81N having a minus ion generator 4N therein and separated from the air flow channel 60N, and an ion outlet 80N formed at a different position from the air outlet 12N to eject minus ions generated by the minus ion generator 4N.

According to the hair dryer described above, since the minus ions supplied from the ion outlet 80N join with the hot air flow provided from the air outlet 11N at outside of the housing 10N. Therefore, it is possible to efficiently spray the hot air with minus ions to the user's hair and perform hair styling.

By the way, the hot air flow is useful to efficiently dry wet hair, but hair styling of the dried hair is generally hard to carry out, so that there is a case that a hair style congenial to the user's taste is not obtained. In such a case, the use of minus ions is particularly useful to obtain moist and smooth hair that is well suited to perform the hair styling. However, since these hair dryers mix the minus ions with the hot air flow, there is still plenty of room for improvement with respect to minus-ion effects on hair. That is, since each of the minus ions is a minute cluster of water molecules in the air coupled with negatively charged oxygen, the minus ions become easier to evaporate in the hot air flow. In other words, as the temperature of minus ions increases, an absorption amount of the minus ions on hair decreases. As a result, it becomes difficult to efficiently perform hair styling, while maintaining the moist and smooth hair.

To improve this problem, for example, it is proposed that after wet hair is dried by use of the hot air flow, the heater is turned off to perform the hair styling by use of the cold air flow with minus ions. However, in this case, it will take an extended time period to finish the hair styling.

SUMMARY OF THE INVENTION

From the above viewpoints, a primary concern of the present invention is to provide a hair dryer with a minus ion generator, which has the capability of simultaneously providing a cold air flow with minus ions and a hot air flow, thereby efficiently performing hair styling, while maintaining moist and smooth hair.

That is, the hair dryer of the present invention comprises a housing having an air inlet and an air outlet, fan disposed between the air inlet and the air outlet in the housing, and a pair of first and second air flow channels extending toward the air outlet in the housing. The first air flow channel has a heater therein, and separated from the second air flow channel by a partition wall, thereby simultaneously providing two air flows having different temperatures from the air outlet. The minus-ion generator disposed in the housing such that the air flow provided by the second air flow channel is mixed with minus ions generated by the minus-ion generator.

According to the hair dryer of the present invention, since a hot air flow and a cold air flow with the minus ions can be simultaneously provided from the air outlet, it is possible to remarkably improve a minus-ion effect on hair, as compared with the conventional hair dryer for simply providing the hot air flow with the minus ions. In addition, since the hair dryer can present a layered air flow composed of the hot air flow and the cold air flow with minus ions, sulfur-to-sulfur bonding of hair in an undesired hair style can be broken by heat energy of the hot air flow of the layer air flow, and new sulfur-to-sulfur bonding can be created in a desired hair style by cooling the hair with the cold air flow of the layer air flow. Therefore, it is possible to efficiently fix the user's hair tousled with sleep or naturally wave hair, and also easily provide a hair style congenial to the user's taste within a shortened time period, as compared with a case that after hair drying is finished by use of the hot air flow, hair styling is performed by use of the cold air flow with minus ions, or that the hair styling and the hair drying are concurrently performed by use of the hot air flow with minus ions.

From the above described reasons, it is particularly preferred that first air flow channel is separated from the second air flow channel by the partition wall such that a layered air flow of a hot air heated by the heater in the first air flow channel and a cold air provided through the second air flow channel is ejected from the air outlet.

To more effectively achieve the above advantages of the present invention, it is preferred that the partition wall is formed by a tubular member, which is disposed in the housing such that one of the first and second air flow channels is provided by an inner space of the tubular member, and the other one is provided by an clearance between an inner surface of the housing and an outer surface of the tubular member. In this case, it is further preferred that the tubular member is disposed in the housing such that a forward end of the tubular member projects from the air outlet.

In addition, it is preferred that the housing has an minus-ion outlet formed at a different position from the air outlet such that the minus ions supplied from the minus-ion outlet is preferentially mixed with the air flow provided from the air outlet through the second air flow channel.

As a preferred embodiment of the present invention, the housing has an ion-flow channel branched from the second air flow channel and coupled to the minus-ion outlet, and the minus ion generator is disposed in the ion-flow channel.

In addition, it is preferred that an air sucked from the air inlet into the housing by the fan is supplied only to the first air flow channel, and an air sucked from a supplemental air inlet of the housing formed at a different position from the air inlet is supplied into the second air flow channel, in which the minus-ion generator is disposed. It is also preferred that the hair dryer further comprises a hair brush member having a plurality apertures for passing the air provided from the air outlet, which is detachably attached to the air outlet of the housing. In this case, it is possible to effectively perform hair brushing, while simultaneously providing the hot air flow and the cold air flow with minus ion from the apertures of the hair brush member.

As another preferred embodiment of the present invention, the housing is formed in an elongate shape with a grip housing, in which the fan and heater are accommodated, and a tubular head detachably attached to the grip housing, and the tubular head has the air outlet, in which a hair brush member having a plurality apertures for passing the air provided from the air outlet is fitted. In addition, it is preferred that the second air flow channel is defined in the tubular head and between a supplemental air inlet formed in the tubular head and the air outlet, and the minus ion generator and an auxiliary fan are disposed in the second air flow channel.

In addition, it is preferred that the hair dryer of the present invention further comprises a nozzle member having a tapered shape and composed of an outer cylindrical wall and an inner cylindrical wall disposed in the outer cylindrical wall. This nozzle member is detachably attached to the air outlet of the housing such that the air flow provided from the inner space of the tubular member is ejected from the nozzle member through an interior of the inner cylindrical wall. In this case, it is also preferred that an inner diameter of a rear end of the inner cylindrical wall is larger than the inner diameter of a front end of the tubular member. Moreover, it is preferred that the nozzle member is formed such that a front end of the inner cylindrical wall is positioned more forward than the front end of the outer cylindrical wall.

A hair dryer according to a further preferred embodiment of the present invention comprises a housing having an air inlet and an air outlet, a fan disposed between the air inlet and the air outlet in the housing, a pair of first and second air flow channels extending toward the air outlet in the housing, a heater disposed in the first air flow channel, a minus-ion generator disposed in the second air flow channel, and a partition wall for separating the first flow channel from the second air flow channel to simultaneously provide two air flows having different temperatures from the air outlet. This partition is wall formed by a tubular member, which is disposed in the housing such that one of the first and second air flow channels is provided by an inner space of the tubular member, and the other one is provided by an clearance between an inner surface of the housing and an outer surface of the tubular member.

These and still other objects and advantages of the present invention will become more apparent from the detail explanation of the invention explained below, referring to the attached drawings.

BRIEF EXPLANATION OF THE DRAWINGS

FIGS. 1A and 1B are side and front cross-sectional views of a hair dryer according to a first embodiment of the present invention;

FIGS. 2A and 2B are schematic diagrams of a minus ion generator of the hair dryer;

FIGS. 3A and 3B are side and front cross-sectional views of a hair dryer according to a modification of the first embodiment;

FIGS. 4A and 4B are side and front cross-sectional views of a hair dryer according to a further modification of the first embodiment;

FIGS. 5A and 5B are side and front cross-sectional views of a hair dryer according to another modification of the first embodiment;

FIGS. 6A and 6B are side and front cross-sectional views of a hair dryer according to still another modification of the first embodiment;

In FIGS. 13A to 13C, FIGS. 13A and 13B are respectively side cross-sectional view and exploded cross-sectional view of a hair dryer according to a fourth embodiment of the present invention, and FIG. 13C is a front view of a hair brush member of the hair dryer;

FIGS. 14A and 14B are respectively side cross-sectional view and exploded cross-sectional view of a hair dryer according to a fifth embodiment of the present invention;

FIG. 15 is a side cross-sectional view of a hair dryer according to a sixth embodiment of the present invention;

FIG. 16A is a side cross-sectional view of a hair dryer according to a modification of the sixth embodiment, and FIG. 16B is a front view of a nozzle member;

DETAIL EXPLANATION OF THE INVENTION

Figure 7A:
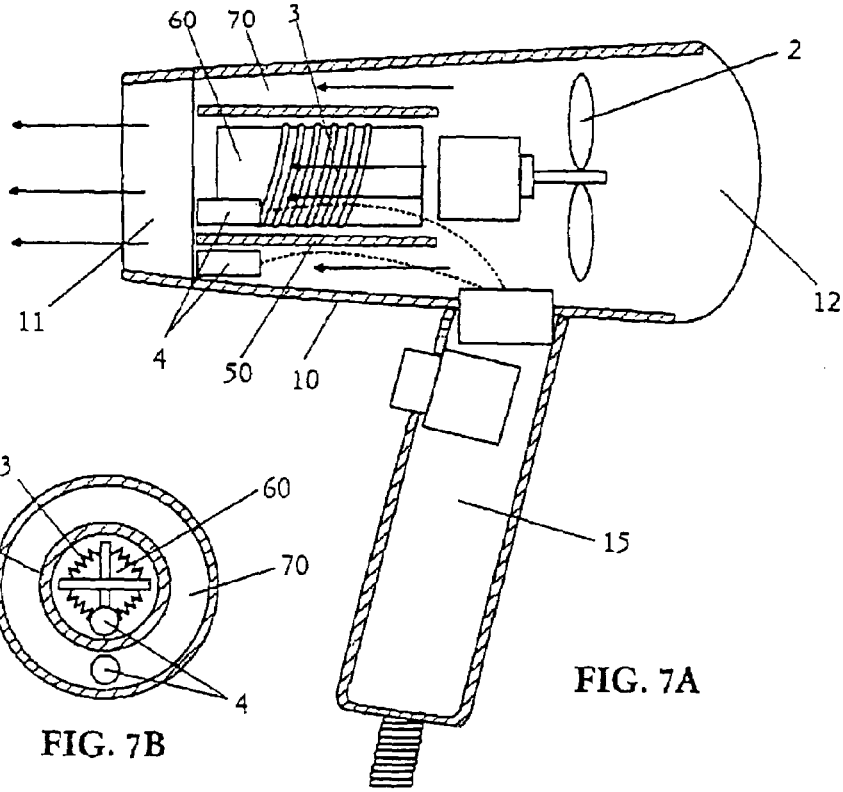
FIGS. 7A and 7B are side and front cross-sectional views of a hair dryer according to another modification of the first embodiment.

Referring to the attached drawings, a hair dryer of the present invention is explained in detail according to preferred embodiments.

First Embodiment

As shown in FIGS. 1A and 1B, a hair dryer 1 of the first embodiment is mainly composed of a hollow housing 10 having an air inlet 12 at its one end and an air outlet 11 at its opposite end, and a grip housing 15 having switches 6 and extending downwardly from the hollow housing.

In the housing, a fan 2 is disposed between the air inlet 12 and the air outlet 11, and a pair of first and second air flow channels (60, 70) are defined, which extend toward the air outlet 11, and separated from each other by a partition wall. In this embodiment, the partition wall is formed by a tubular member 50, which is disposed in the housing 10 such that the first air flow channel 60 is provided by an inner space of the tubular member, and the second air flow channel 70 is provided by an clearance between an inner surface of the housing and an outer surface of the tubular member. A heater 3 is disposed in the first air flow channel 60, and a minus-ion generator 4 is disposed in the second air flow channel 70. Therefore, the first air flow channel 60 is used to provide a hot air flow heated by the heater 3, and the second air flow channel 70 is used to provide a cold air flow (i.e., air flow at room temperature) with minus ions generated by the minus ion generator 4. In the drawings, the numeral 20 designates a motor for driving the fan 2, and the numeral 40 designates a high voltage generator of the minus ion generator 4.

In the hair dryer 1 described above, by driving the fan 2, a part of the air sucked in the housing 10 through the air inlet 12 is heated by the heater 3, and then ejected as the hot air flow from the air outlet 11 through the first air flow channel 60. On the other hand, the balance of the sucked air joins with the minus ions generated by the minus ion generator 4 in the second air flow channel 70, and then ejected as the cold air flow with minus ions from the air outlet 11. In other words, since the partition wall 50 is formed by the tubular member, a layered air flow composed of a core of the hot air flow and an external layer of the cold air flow with minus ions provided around the core can be provided from the air outlet 11.

As shown in FIGS. 2A and 2B, the minus ion generator 4 comprises a discharge unit and a high voltage generator 40. The discharge unit is composed of a needle-like electrode 41, ground electrode 42 spaced away from the needle-like electrode by a required distance, and a casing 43 made of an insulating material to hold these electrodes. The needle-like electrode 41 and the ground electrode 42 are respectively connected to the high voltage generator 40 by lead wires. To generate minus ions by the minus ion generator 4, the high voltage generator 40 develops a voltage such that a negative high voltage (e.g., −5 kV) is applied to the needle-like electrode 41 with reference to the ground electrode 42. Thereby, a corona discharge happens between those electrodes to generate the minus ions. A conventional minus ion generator is available to the hair dryer of the present invention.

In addition, the hair dryer of the present embodiment has a control unit for selectively providing one of a plurality of air flow modes in response to the user's operation of the switches 6 on the grip housing 15. That is, this control unit can selectively provide one of a first mode of simultaneously providing the hot air flow and the cold air flow with minus ions from the air outlet 11 (heater 3: ON, minus ion generator 4: ON), second mode of providing the hot air flow and the cold air flow without minus ions from the air outlet (heater 3: ON, minus ion generator 4: OFF), third mode of providing only the cold air flow with minus ions from the air outlet (heater: OFF, minus ion generator: ON), and a forth mode of simply providing the cold air flow from the air outlet (heater 3: OFF, minus ion generator 4: OFF).

As a modification of this embodiment, a plurality of minus ion generators 4 may be disposed in the second air flow channel 70, as shown in FIGS. 3A and 3B. The number of the minus ion generators 4 to be disposed can be determined according to a desired supply amount of minus ions. In addition, from the viewpoint of providing the air flow, in which the minus ions are uniformly distributed, it is preferred that the minus ion generators 4 are spaced away from each other around an axis of the tubular member by a required angle. For example, in the case of using a pair of minus ion generators, it is preferred that they are spaced away from each other around the axis of the tubular member by 180 degrees. In addition, when four minus ion generators are used, it is preferred that they are spaced away from each other around the axis of the tubular member by 90 degrees.

As a further modification of this embodiment, as shown in FIGS. 4A and 4B, it is also preferred that the first air flow channel 60, in which the heater 3 is disposed, is provided by the clearance between the inner surface of the housing 10 and the outer surface of the tubular member 50, and the second air flow channel 70, in which the minus ion generator 4 is disposed, is provided by the inner space of the tubular member. Therefore, in this case, it is possible to eject a layered air flow composed of a core of the cold air flow with minus ions and an external layer of the hot air flow provided around the core from the air outlet 11. To obtain a uniform temperature distribution of the hot air flow in the first air flow channel 60, it is preferred the heater 3 extends over the entire circumference of the tubular member 50, as shown in FIG. 4B.

In the present embodiment and its modification described above, since the heater 3 is disposed in one of two air flow channels, and the minus ion generator is disposed in the other one, it is possible to preferentially add the minus ions to the cold air flow, while preventing a situation that the minus ions flow into the hot air flow heated by the heater. However, when the following condition is satisfied, both of the heater 3 and the minus ion generator 4 can be disposed in the same air flow channel. That is, as shown in FIGS. 5A and 5B, when the heater 3 is disposed in the first air flow channel 60 provided by the inner space of the tubular member 50, and the minus ion generator 4 is positioned in the vicinity of an exit of the first air flow channel 60, i.e., a forward end portion of the tubular member 50, major part of the minus ions generated by the minus ion generator 4 can join with the cold air flow provided from the second air flow channel 70 defined between the inner surface of the housing 10 and the outer surface of the tubular member 50. In this case, even when a part of the minus ions join with the hot air flow provided from the first air flow channel 60, they can be cooled by the cold air flow adjacent to this hot air flow. Therefore, it is possible to minimize an increase in temperature of the minus ions.

Similarly, as shown in FIGS. 6A ad 6B, when the heater 3 is disposed in the first air flow channel 60 defined between the inner surface of the housing 10 and the outer surface of the tubular member 50, and the minus ion generator 4 is positioned in the vicinity of an exit of the first air flow channel, major part of the minus ions generated by the minus ion generator can join with the cold air flow provided from the second air flow channel 70 defined in the inner space of the tubular member.

Figure 7B:
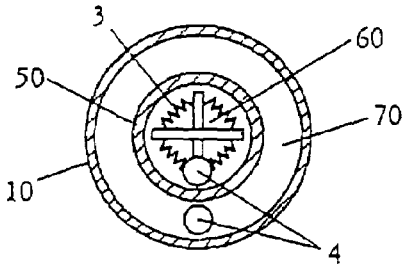

As a combination of the above-described modifications, for example, as shown in FIGS. 7A and 7B, it is preferred that the heater 3 is disposed in the first air flow channel 60 provided by the inner space of the tubular member 50, the minus ion generator 4 is positioned in the vicinity of an exit of the first air flow channel, and a second minus ion generator 4 is positioned in a second air flow channel 70 provided by a clearance between the inner surface of the housing 10 and the outer surface of the tubular member.

Figure 8A:
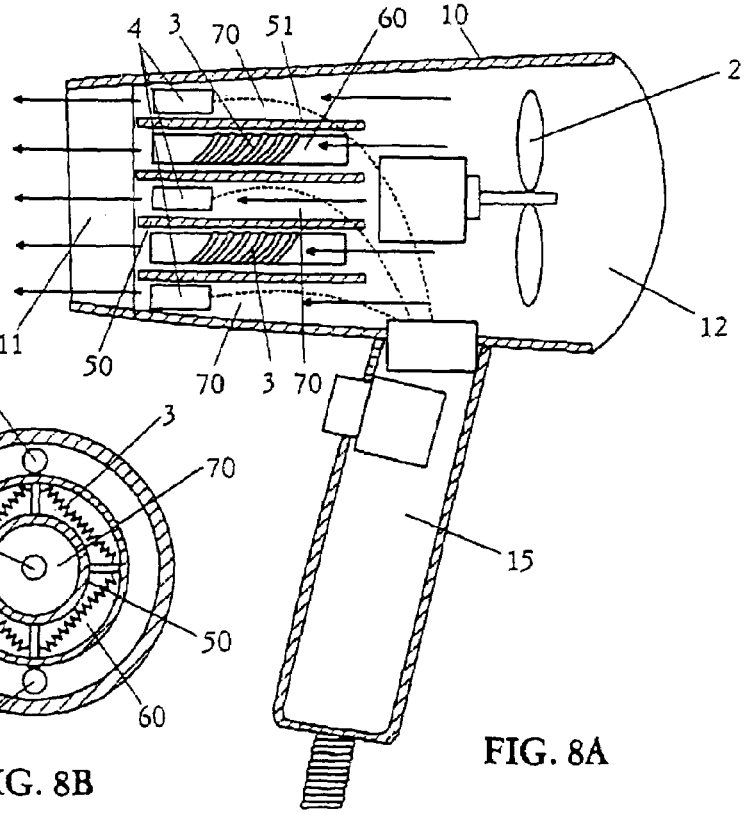
FIGS. 8A and 8B are side and front cross-sectional views of a hair dryer according to another modification of the first embodiment.
Figure 8B:
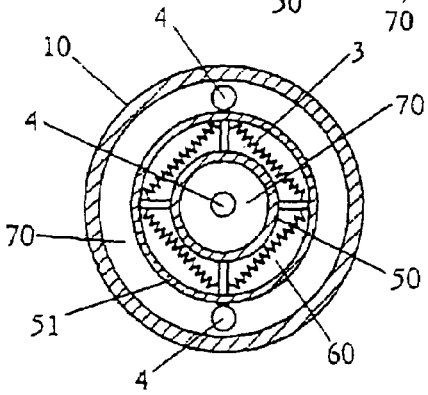

In addition, as another modification of this embodiment, as shown in FIGS. 8A and 8B, it is preferred that the partition wall is formed in a double cylinder structure, which is composed of a pair of tubular members (50, 51) having different diameters. For example, a required number of the minus ion generators 4 can be disposed in an inner space of the tubular member 50 having a smaller diameter as well as a clearance between the inner surface of the housing 10 and an outer surface of the tubular member 51 having a larger diameter. On the other hand, the heater 3 can be placed between the outer surface of the tubular member 50 having the smaller diameter and the inner surface of the tubular member 51 having the larger diameter. Therefore, this hair dryer can present a three-layered air flow composed of a core and the outermost layer of the cold air flow with minus ions, and an intermediate layer of the hot air flow between the core and the outermost layer from the air outlet 11.

In the present embodiment and the modifications described above, it is also preferred that the tubular member 50 has a length in the axial direction determined such that one end of the tubular member substantially reaches the air outlet 11. In this case, the hot air flow ejected from one of the two air flow channels join with the cold air flow with minus ions ejected from the other one at the outside of the housing. Therefore, it is possible to stably supply the layered air flow from the air outlet 11, while preventing the occurrence of a turbulent flow in the housing.

Moreover, it is preferred that a direction of the air flow supplied from the first air flow channel 60 is substantially parallel to the direction of the air flow supplied from the second air flow channel 70. In this case, since the cold air flow with minus ions does not flow into the hot air flow, it is possible to stably provide the layered air flow effective to hair styling. In addition, it is possible to prevent a situation that an average temperature of the minus ions raises due to an increase in contact with the hot air flow.

Second Embodiment

A hair dryer according to the second embodiment is substantially the same as the hair dryer of the first embodiment other than the following features. Therefore, the duplicate explanation is omitted.

Figure 9:
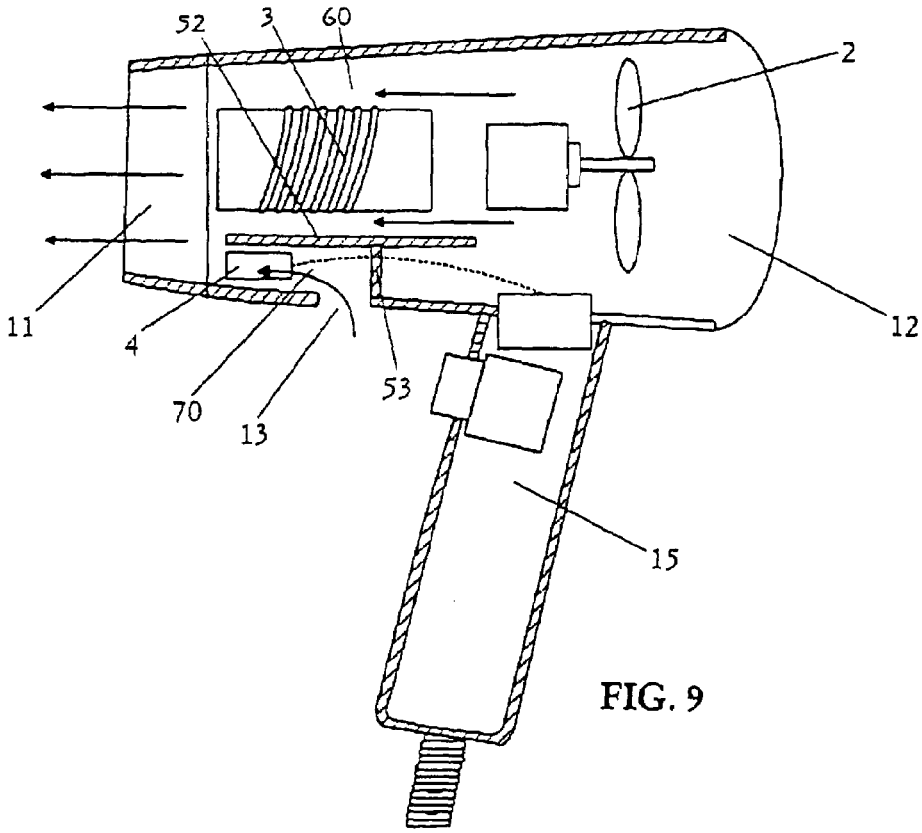
FIG. 9 is a side cross-sectional view of a hair dryer according to a second embodiment of the present invention.

In the subject embodiment, as shown in FIG. 9, an air sucked from the air inlet 12 into the housing 10 by the fan 2 is supplied only to the first air flow channel 60, in which the heater 3 is placed. An air to be supplied into the second air flow channel 70, in which the minus ion generator 4 is disposed, is sucked from a supplemental air inlet 13 formed in the housing 10 at a different position from the air inlet 12. In this case, a partition wall for separating the first air flow channel from the second air flow channel is composed of a horizontal wall 52 and a vertical wall 53. Therefore, the first air flow channel 60 is defined between the top surface of the horizontal wall 52 and the inner surface of the housing 10, and the second air flow channel 70 is defined by a space surrounded by the bottom surface of the horizontal wall 52, the vertical wall 53 and the inner surface of the housing 10 and coupled with the supplemental air inlet 13.

In this case, since the air existing at the vicinity of a forward end of the second air flow channel 70 is carried away by the air flow ejected from the first air flow channel 60, the air pressure in the second air flow channel 70 reduces. As a result, the outside air can flow into the second air flow channel 70 from the supplemental air inlet 13 by itself. If necessary, an auxiliary fan may be disposed in the second air flow channel.

Third Embodiment

A hair dryer according to the third embodiment is substantially the same as the hair dryer of the first embodiment except for the following features. Therefore, the duplicate explanation is omitted.

Figure 10:
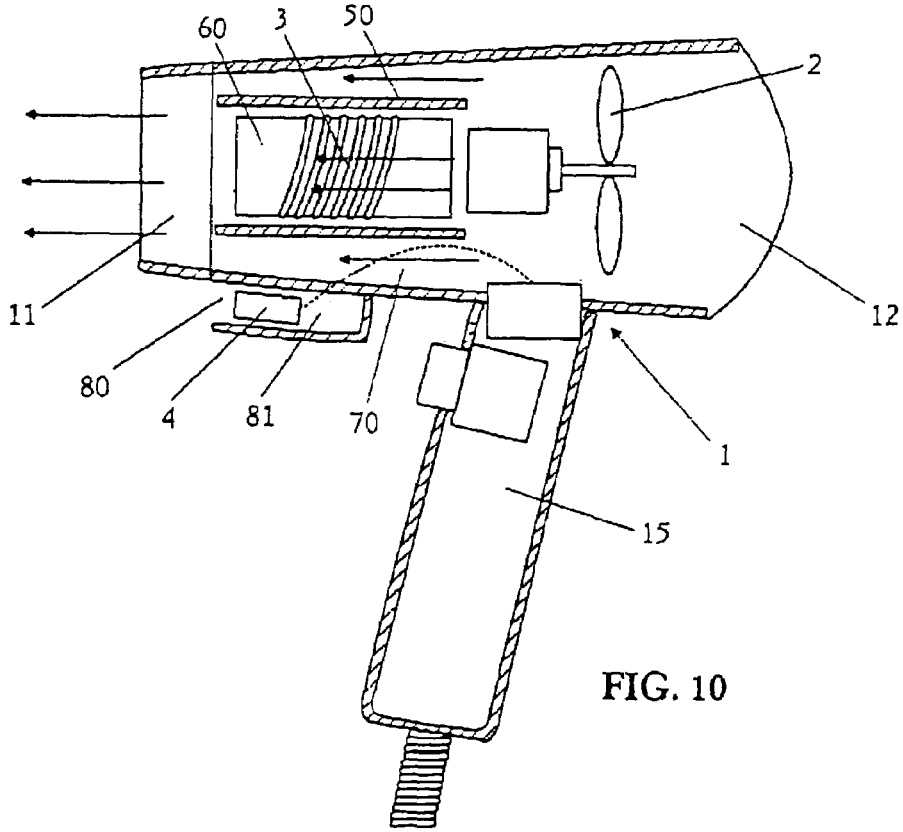
FIG. 10 is a side cross-sectional view of a hair dryer according to a third embodiment of the present invention.

The present embodiment is, as shown in FIG. 10, characterized in that the housing 10 has a minus-ion outlet 80 formed at a different position from the air outlet 11 to eject minus ions generated by the minus ion generator 4. That is, an accommodation room 81 for the minus ion generator 4 is completely separated from the first and second air flow channels (60, 70). Therefore, the minus ions generated by the minus ion generator 4 diffuses into the outside air through the minus-ion outlet 80, and then join with the cold air flow ejected from the air outlet 11. In this case, since the layered air flow provided from the air outlet 11 is composed of the core of the hot air flow and the external layer of cold air flow with minus ions around the core from the air outlet, the minus ions diffused from the minus-ion outlet can be carried away by the cold air flow without contacting the hot air flow. In addition, the minus-ion outlet 80 is oriented such that the minus ions efficiently contact the cold air flow provided from the air outlet 11. If necessary, an auxiliary fan may be disposed in the accommodation room 81.

By the way, there is a case that a barrier member (not shown) such as a net-like or grid member is attached to the air outlet 11 to prevent inhalation of foreign substance into the housing 10. In such a case, when the cold air flow with minus ions is provided from the air outlet, there is a fear that a part of the minus ions are caught by the barrier member. However, since the hair dryer of this embodiment has the ion outlet 80 independently formed from the air outlet 11, there is an advantage that even when the barrier member is attached to the air outlet, the supply amount of the minus ions can be stably maintained.

Figure 11:
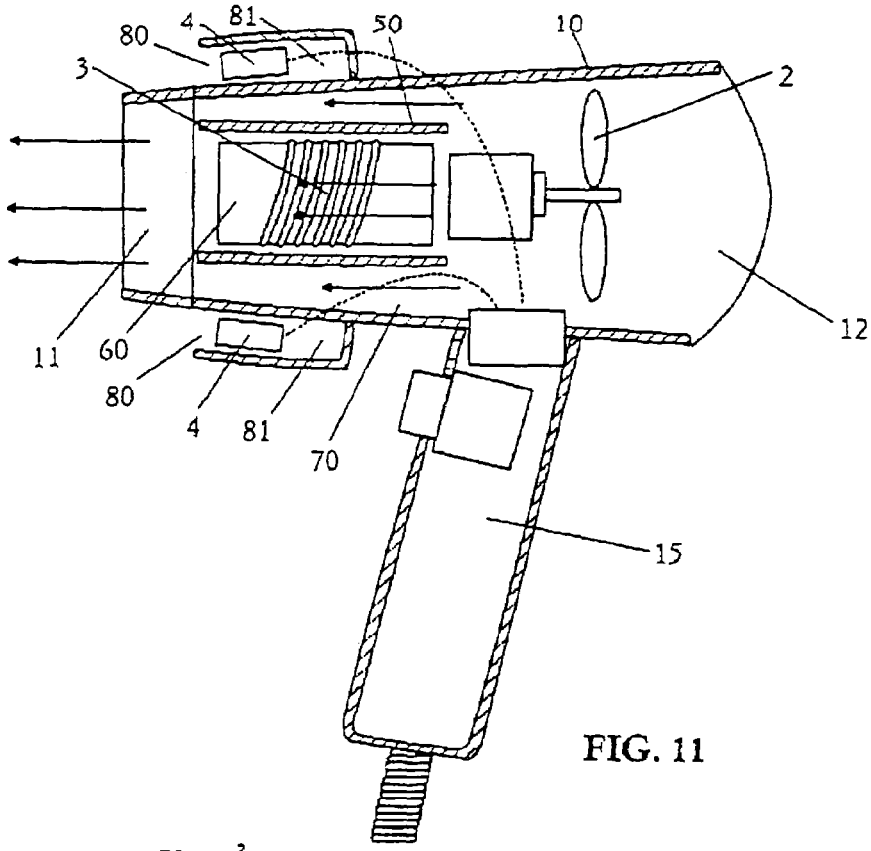
FIG. 11 is a side cross-sectional view of a hair dryer according to a modification of the third embodiment.

As a modification of this embodiment, as shown in FIG. 11, a plurality of accommodation rooms 81 for the minus ion generator 4 may be disposed on the housing 10 around the air outlet 11. The number of the accommodation rooms to be disposed can be determined according to a desired supply amount of minus ions. In this figure, a pair of accommodation rooms 81 are formed on the housing 10 so as to be spaced away from each other around the axis of the tubular member 50 by 180 degrees.

Figure 12:
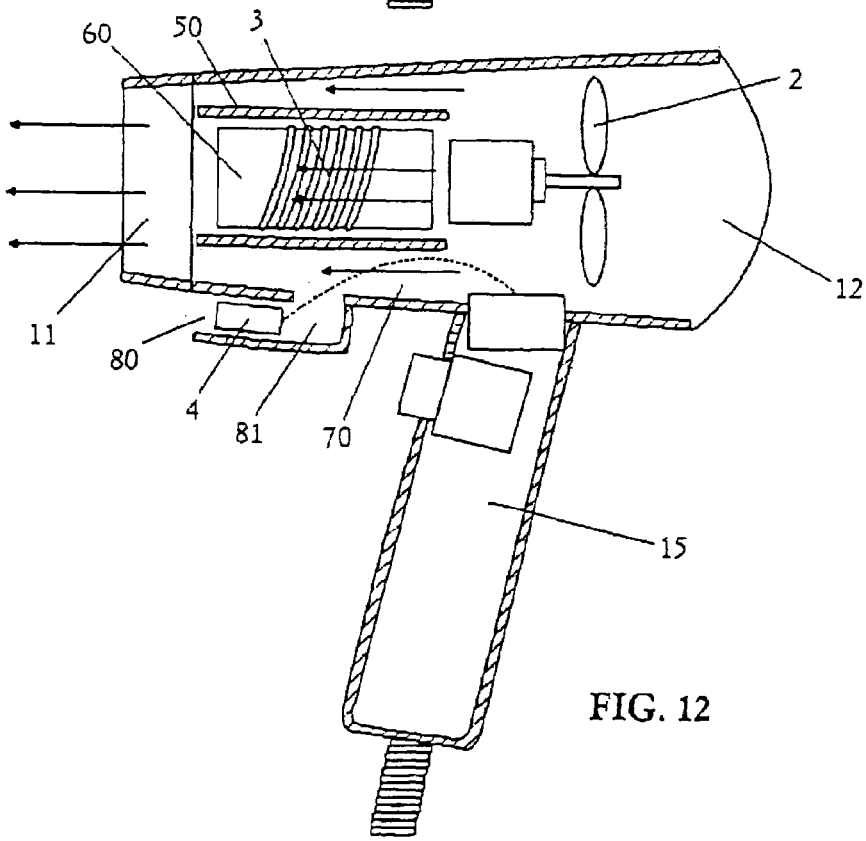
FIG. 12 is a side cross-sectional view of a hair dryer according to a further modification of the third embodiment.
Figure 17:
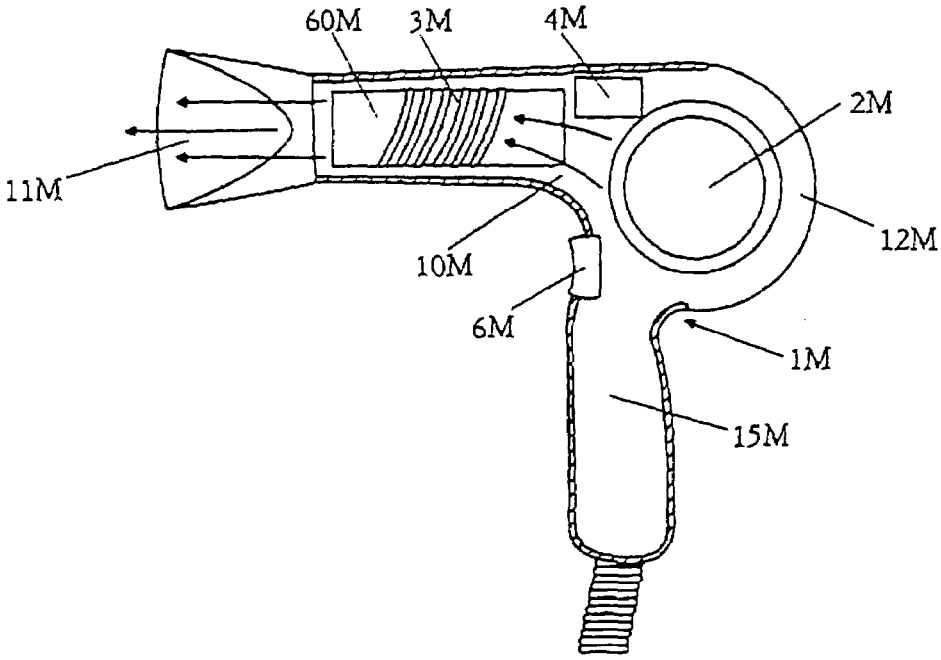
FIG. 17 (PRIOR ART)
FIG. 17 is a side cross-sectional view of a conventional hair dryer.
Figure 18:
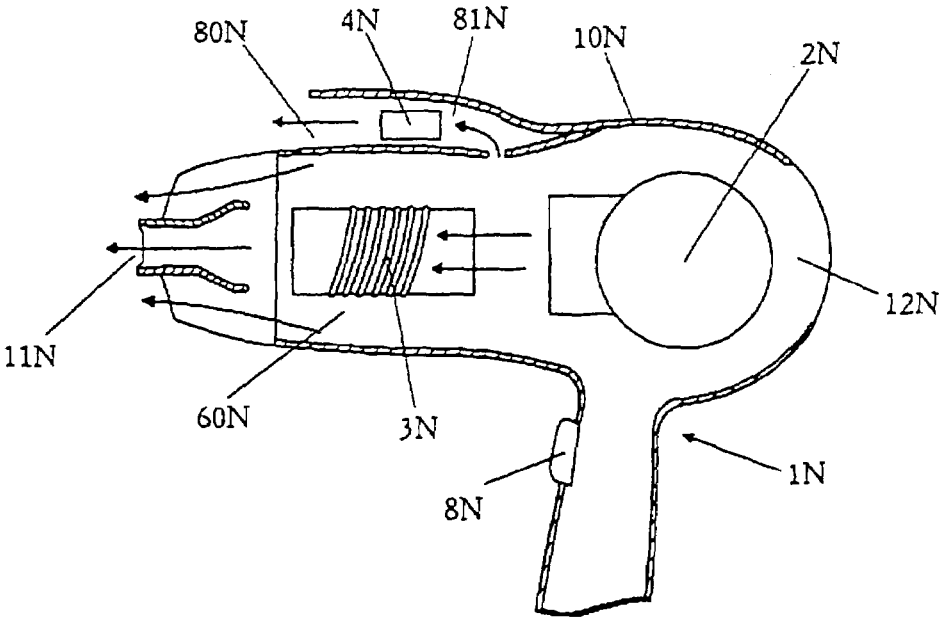
FIG. 18 (PRIOR ART)
FIG. 18 is a side cross-sectional view of another conventional hair dryer.

As a further modification of this embodiment, as shown in FIG. 12, the accommodation room 81 for the minus ion generator 4 may be coupled with the second air flow channel 70 defined between the inner surface of the housing 10 and the outer surface of the tubular member 50. In this case, since a part of the air in the second air flow channel 70 flows into the accommodation room 81, the minus ions can be ejected together with the air from the ion outlet 80.

In addition, since the ion outlet 80 is positioned near the air outlet 11, the air flow with minus ion ejected from the ion outlet 80 easily merges with the layered air flow provided from the air outlet 11. As a result, it is possible to effectively spay the layered air flow including the minus ions to a desired region of the user's hair.

Fourth Embodiment

A hair dryer according to the fourth embodiment is characterized by comprising a hair brush attached to an air outlet.

That is, as shown in FIGS. 13A to 13C, a housing 10 of the present hair dryer is formed in an elongate shape with a grip housing 15 for accommodating a fan 2 and a heater 3 therein, and a tubular head 16 for accommodating a minus ion generator 4 therein, which is detachably attached to the grip housing. In conjunction with the grip housing 15, the tubular head 16 presents a pair of first and second air flow channels (60, 70) extending between the fan 2 and the air outlet 11 and separated from each other by a partition wall.

The partition wall is composed of a first wall 55 extending in the longitudinal direction of the housing 10 and a second wall 56 extending perpendicularly from one end of the first wall. The second wall 56 divides the air outlet 11 into a hot air outlet for providing the hot air flow through the first air flow channel 60 and a cold air outlet for providing the cold air flow with minus ions through the second air flow channel 70. Therefore, according to the hair dryer of this embodiment, major part of the air sucked in the housing 10 by the fan 2 through an air inlet 12 is heated by the heater 3, and then ejected from the air outlet 11 through the first air flow channel 60. On the other hand, the balance of the air sucked by the fan 2 merges with the minus ions generated by the minus ion generator 4 in the second air flow channel 70, and then the cold air with the minus ions is supplied from the air outlet 11.

As shown in FIG. 13C, the tubular head 16 has a hair brush member 9 detachably attached to the air outlet 11, which includes a base 90 having a plurality apertures 92 for passing the air provided from the air outlet, and a plurality of brush bristles 91 projecting on the base. Therefore, it is possible to effectively perform hair brushing, while providing the layered air flow of the hot air flow and cold air flow with minus ions from the apertures 92 of the hair brush member 9.

Fifth Embodiment

A hair dryer according to the fifth embodiment is substantially the same as the hair dryer of the fourth embodiment except for the following features. Therefore, the duplicate explanation is omitted.

In the hair dryer of this embodiment, as shown in FIGS. 14A and 14B, the second air flow channel 70 for providing the cold air flow with minus ions is only formed in the tubular head 16. The second air flow channel 70 is separated from the first air flow channel 60 for providing the hot air flow by a vertical wall 57 projecting from an inner surface of the tubular head 16 toward the air outlet 11. The tubular head 16 also has a supplemental air inlet 18, through which outside air is sucked into the second air flow channel 70 by use of an auxiliary fan 25.

Therefore, according to the hair dryer of this embodiment, the air sucked by the fan 2 in the housing 10 through the air inlet 12 is heated by the heater, and then ejected from the air outlet 11 through the first air flow channel 60. On the other hand, the air sucked by the auxiliary fan 25 merges with the minus ions generated by the minus ion generator 4 in the second air flow channel 70 and then the cold air with minus ions is ejected from the air outlet 11. As a result, as in the case of the fourth embodiment, it is possible to effectively perform hair brushing, while ejecting the layered air flow of the hot air flow and cold air flow with minus ions from the apertures 92 of the hair brush member 9.

Sixth Embodiment

A hair dryer according to the sixth embodiment is substantially the same as the hair dryer of the third embodiment except for the following features. Therefore, the duplicate explanation is omitted.

The hair dryer of the present embodiment is, as shown in FIG. 15, characterized in that the housing 10 has a pair of minus-ion outlets 80 formed at different positions from the air outlet 11 to eject minus ions generated by the minus ion generators 4. A pair of accommodation rooms 81 for the minus ion generators 4 are formed on the housing 10 so as to be spaced away from each other around an axis of the tubular member 50 by 180 degrees. Each of the accommodation rooms 81 is communicated with the second air flow channel 70 defined between the inner surface of the housing 10 and the outer surface of the tubular member 50. Since a part of the air in the second air flow channel 70 flows into the accommodation room 81, the minus ions are ejected together with the cold air from the minus-ion outlet 80, and then join with the cold air flow ejected from the air outlet 11. Therefore, in this case, since the layered air flow provided from the air outlet 11 is composed of the core of the hot air flow and the external layer of the cold air flow around the core, the minus ions supplied from the minus-ion outlet can be carried away by the cold air flow without contacting the hot air flow. In addition, the minus-ion outlet 80 is oriented such that the minus ions efficiently contact the cold air flow provided from the air outlet 11.

The hair dryer of the present embodiment is also characterized in that the tubular member 50 is disposed in the housing 10 such that a forward end of the tubular member projects from the air outlet 11, as shown in FIG. 15. The minus ions supplied from the minus-ion outlet 80 flow along the outer surface of the housing 10, and then join with the cold air flow ejected from the air outlet 11 through the second air flow channel 70 before the cold air flow contacts with the hot air flow provided from the air outlet 11 through the first air flow channel 60. Therefore, it is possible to stably supply the layered air flow from the air outlet 11, while preventing the occurrence of a turbulent flow in the housing and an increase in average temperature of the minus ions. As a result, there is an advantage that the layered air flow including the minus ions kept at a relatively low average temperature can be effectively spayed to a desired region of the user's hair.

As a modification of this embodiment, as shown in FIGS. 16A and 16B, a nozzle member 30 may be detachably attached to the air outlet 11 of the housing 10. That is, this nozzle member 30 is composed of an outer cylindrical wall 31, inner cylindrical wall 32 disposed in the outer cylindrical wall, and four supports 33 each coupling the inner cylindrical wall to the outer cylindrical wall. A front 25 end of the inner cylindrical wall 32 is positioned more forward than the front end of the outer cylindrical wall 31. In other words, the nozzle member 30 is formed such that the inner cylindrical wall 32 projects from the interior of the outer cylindrical end 31.

In addition, the nozzle member 30 is configured in a tapered shape to focus each of the hot and cold air flows ejected from the air outlet 11. When the nozzle member 30 is formed such that the inner surface of the outer cylindrical wall 31 extends substantially parallel to the inner surface of the inner cylindrical wall 32, it is possible to focus the layered air flow, while maintaining flow directions of the hot and cold air flows in parallel. Moreover, it is preferred that an inner diameter "D2" of the rear end of the inner cylindrical wall 32 is substantially equal to or slightly larger than the inner diameter "D1" of the front end of tubular member 50. In this case, it is possible to prevent a situation that the hot air flow provided from the inner space of the tubular member 50 accidentally flows in the clearance between the inner and outer cylindrical walls (31, 32), in which the cold air flows.

According to the hair dryer of this modification, when the nozzle member 30 is not attached to the housing 10, it is possible to provide a wide and soft air flow from the air outlet 11, which is composed of the hot air flow provided from the inner space of the tubular member 50 and the cold air flow from the clearance between the inner surface of the housing 10 and the outer surface of the tubular member 50. Then, the minus ions supplied from the minus-ion outlet 80 join with the cold air flow provided from the air outlet 11.

On the other hand, when the nozzle member 30 is attached to the housing 10, it is possible to provide a narrow and strong air flow from the nozzle member 30, which is composed of the hot air flow provided from the interior of the inner cylindrical wall 32 and the cold air flow provided from the clearance between the outer and inner cylindrical walls (31, 32). As in the case of FIG. 15, the minus ions generated by the minus-ion generator 4 and supplied from the minus-ion outlet 80 join with the cold air flow ejected from the nozzle member 30. Therefore, the same advantage as the embodiment of FIG. 15 can be also achieved in this modification. In addition, this focused layered air flow is effective to locally perform the hair styling with efficiency.

As a further modification of the present embodiment, when the minus ion generator 4 is disposed in the tubular member 50, as shown in FIGS. 4A and 4B, it is preferred that the nozzle member is formed such that the front end of the outer cylindrical wall is positioned more forward than the front end of the inner cylindrical wall.

What is claimed is:

1. A hair dryer with a minus ion generator comprising:

a housing having an air inlet and an air outlet;

a fan disposed between said air inlet and said air outlet in said housing;

a tubular member disposed in said housing to form a hot airflow channel defined by a inner space of said tubular member, and a cold airflow channel defined by a clearance between an inner surface of said housing and an outer surface of said tubular member, thereby simultaneously providing both of a hot airflow and a cold airflow from said air outlet;

a heater disposed in the inner space of said tubular member to generate the hot airflow in said hot airflow channel; and a minus ion outlet formed at a different position from said air outlet in said housing such that minus ions generated by said minus ion generator and provided from said minus ion outlet are preferentially mixed with the cold airflow provided from said cold airflow channel, wherein said housing has a plurality of accommodation rooms for minus ion generators with minus ion outlets, which are disposed on said housing so as to be spaced from each other around an axis of said tubular member.

2. The hair dryer as set forth in claim 1, further comprising a nozzle member having a tapered shape and composed of an outer cylindrical wall and an inner cylindrical wall disposed in said outer cylindrical wall, and wherein said nozzle member is detachably attached to said air outlet of said housing such that the hot airflow provided from the inner space of said tubular member is ejected from said nozzle member through an interior of said inner cylindrical wall.

3. A hair dryer as set forth in claim 2, wherein an inner diameter of a rear end of said inner cylindrical wall of said nozzle member is larger than the inner diameter of a front end of said tubular member.

4. A hair dryer with a minus ion generator comprising:

a housing having an air inlet and an air outlet;

a fan disposed between said air inlet and said air outlet in said housing;

a tubular member disposed in said housing to form a hot airflow channel defined by a inner space of said tubular member, and a cold airflow channel defined by a clearance between an inner surface of said housing and an outer surface of said tubular member, thereby simultaneously providing both of a hot airflow and a cold airflow from said air outlet;

a heater disposed in the inner space of said tubular member to generate the hot airflow in said hot airflow channel; and a minus ion outlet formed at a different position from said air outlet in said housing such that minus ions generated by said minus ion generator and provided from said minus ion outlet are preferentially mixed with the cold airflow provided from said cold airflow channel; and a nozzle member having a tapered shape and composed of an outer cylindrical wall and an inner cylindrical wall disposed in said outer cylindrical wall, and detachably attached to said air outlet of said housing such that said hot airflow provided from the inner space of said tubular member is ejected from said nozzle member through an interior of said inner cylindrical wall, wherein said nozzle member is formed such that a front end of said inner cylindrical wall is positioned more forward than the front the front end of said outer cylindrical wall.

5. A hair dryer with a minus ion generator comprising:

a housing having an air inlet and an air outlet;

a fan disposed between said air inlet and said air outlet in said housing;

a tubular member disposed in said housing to form a hot airflow channel defined by a inner space of said tubular member, and a cold airflow channel defined by a clearance between an inner surface of said housing and an outer surface of said tubular member, thereby simultaneously providing both of a hot airflow and a cold airflow from said air outlet;

a heater disposed in the inner space of said tubular member to generate the hot airflow in said hot airflow channel; and a minus ion outlet formed at a different position from said air outlet in said housing such that minus ions generated by said minus ion generator and provided from said minus ion outlet are preferentially mixed with the cold airflow provided from said cold airflow channel wherein said tubular member is disposed in said housing such that a forward end of said tubular member projects from said air outlet.

6. A hair dryer with a minus ion generator comprising:

a housing having an air inlet and an air outlet;

a fan disposed between said air inlet and said air outlet in said housing;

a tubular member disposed in said housing to form a hot airflow channel defined by a inner space of said tubular member, and a cold airflow channel defined by a clearance between an inner surface of said housing and an outer surface of said tubular member, thereby simultaneously providing both of a hot airflow and a cold airflow from said air outlet;

a heater disposed in the inner space of said tubular member to generate the hot airflow in said hot airflow channel; and a minus ion outlet formed at a different position from said air outlet in said housing such that minus ions generated by said minus ion generator and provided from said minus ion outlet are preferentially mixed with the cold airflow provided from said cold airflow channel, wherein said housing is formed in an elongate shape with a grip housing, in which said fan and said heater are accommodated, and a hair brush member detachably attached to said grip housing, and said hair brush member is of a tubular structure having a plurality of apertures at its one end to provide a layered airflow of the hot airflow and the cold airflow with the minus ions.

* * * * *